US011512400B2

(12) United States Patent
Al-Rowaili et al.

(10) Patent No.: US 11,512,400 B2
(45) Date of Patent: Nov. 29, 2022

(54) ELECTROCHEMICAL REDUCTION OF CARBON DIOXIDE

(71) Applicants: Saudi Arabian Oil Company, Dhahran (SA); King Fahd University of Petroleum & Minerals, Dhahran (SA)

(72) Inventors: Fayez Nasir Al-Rowaili, Dhahran (SA); Mazen Khaled, Ardross (AU); Aqil Jamal, Dhahran (SA); Sagheer A. Onaizi, Dhahran (SA); Umer Zahid, Dhahran (SA)

(73) Assignees: Saudi Arabian Oil Company, Dhahran (SA); King Fahd University of Petroleum & Minerals, Dhahran (SA)

( * ) Notice: Subject to any disclaimer, the term of this patent is extended or adjusted under 35 U.S.C. 154(b) by 0 days.

(21) Appl. No.: 17/118,075

(22) Filed: Dec. 10, 2020

(65) Prior Publication Data

US 2022/0186385 A1 Jun. 16, 2022

(51) Int. Cl.

| | |
|---|---|
| ***C25B 3/07*** | (2021.01) |
| ***C25B 3/26*** | (2021.01) |
| ***C25B 11/052*** | (2021.01) |
| ***C25B 11/075*** | (2021.01) |
| ***C25D 3/38*** | (2006.01) |
| ***C25F 3/18*** | (2006.01) |

(52) U.S. Cl.

CPC ..... *C25B 3/26* (2021.01); *C25B 3/07* (2021.01); *C25B 11/052* (2021.01); *C25B 11/075* (2021.01); *C25D 3/38* (2013.01); *C25F 3/18* (2013.01)

(58) Field of Classification Search

CPC ..... C25B 3/07; C25B 3/36

USPC ..... 205/450

See application file for complete search history.

(56) References Cited

U.S. PATENT DOCUMENTS

| | | | |
|---|---|---|---|
| 2,694,678 | A | 1/1951 | George et al. |
| 2,645,611 | A | 7/1953 | Axtell |
| 2,753,301 | A | 7/1956 | Bersworth et al. |
| 7,112,271 | B2 | 9/2006 | Jo et al. |
| 7,501,051 | B2 | 3/2009 | Shieh et al. |
| 9,481,938 | B2 | 11/2016 | Shin et al. |
| 10,131,602 | B1 | 11/2018 | Gondal et al. |
| 10,161,051 | B2 | 12/2018 | Palmore et al. |
| 10,329,677 | B2 | 6/2019 | Geioushy et al. |

(Continued)

FOREIGN PATENT DOCUMENTS

| | | |
|---|---|---|
| CN | 105386124 | 3/2016 |
| CN | 107177862 | 9/2017 |

(Continued)

OTHER PUBLICATIONS

Chen et al., "Electrochemical Reduction of Carbon Dioxide to Ethane Using Nanostructured Cu2O-Derived Copper Catalyst and Palladium (II) Chloride," The Journal of Physical Chemistry C. (Dec. 3, 2015), vol. 119, No. 48, pp. 26875-26882. (Year: 2015).*

(Continued)

*Primary Examiner* — Edna Wong

(74) *Attorney, Agent, or Firm* — Fish & Richardson P.C.

(57) ABSTRACT

A method and an electrocatalytic electrode for electrochemically reducing carbon dioxide to methanol are provided. An exemplary electrocatalytic electrode includes copper (I) oxide crystals electrodeposited over an atomically smooth copper electrode.

12 Claims, 10 Drawing Sheets

200

(56) References Cited

U.S. PATENT DOCUMENTS

| | | | | |
|---|---|---|---|---|
| 10,590,548 | B1 * | 3/2020 | McGinnis | C25B 9/19 |
| 2004/0262168 | A1 | 12/2004 | Huo et al. | |
| 2008/0067077 | A1 | 3/2008 | Kodera et al. | |
| 2010/0193370 | A1 | 8/2010 | Olah et al. | |
| 2011/0114502 | A1 | 5/2011 | Cole et al. | |
| 2013/0256124 | A1 | 10/2013 | Rahman et al. | |
| 2014/0246399 | A1 | 9/2014 | Chiba | |
| 2015/0004329 | A1 | 1/2015 | Abuhimd et al. | |
| 2015/0047986 | A1 | 2/2015 | Shin et al. | |
| 2017/0073824 | A1 | 3/2017 | Kudo et al. | |
| 2019/0035640 | A1 | 1/2019 | Thorkelsson et al. | |
| 2019/0067706 | A1 | 2/2019 | Liu et al. | |

FOREIGN PATENT DOCUMENTS

| | | | | |
|---|---|---|---|---|
| EP | 0892862 | | 1/1999 | |
| EP | 1666258 | | 6/2006 | |
| EP | 1666258 | A2 * | 6/2006 | B41J 2/1606 |
| EP | 1967616 | A1 * | 9/2008 | C25D 11/18 |
| WO | 2006037584 | | 4/2006 | |
| WO | 2011063353 | | 5/2011 | |
| WO | 2016193736 | | 12/2016 | |

OTHER PUBLICATIONS

Wang, "Electrolytic Coloring of Copper," Diandu Yu Huanbao (1988), vol. 8, No. 5, pp. 10-11. Abstract Only. (Year: 1988).*

Walton, "The Anode Layer in the Electrolytic Polishing of Copper," Journal of the Electrochemical Society (Jul. 1, 1950), vol. 97, No. 7, pp. 219-226. (Year: 1950).*

Abrams, "Electrolytic polishing of copper and nickel silver" 1965, 104 pages.

Awad et al., "Removal of tarnishing and roughness of copper surface by electropolishing treatment" Applied Surface Science 256.13, Apr. 2010, 4370-4375, 6 pages.

Gamry.com [online], "Two Three and Four Electrode Experiments" available on or before Sep. 19, 2020, via internet Archive : Wayback Machine URL <https://web.archive.org/web/20200919155301/https://www.gamry.com/application-notes/instrumentation/two-three-four-electrode-experiments/>, retrieved on Jan. 3, 2022, URL <https://www.gamry.com/application-notes/instrumentation/two-three-four-electrode-experiments/>, 5 pages.

Kwon et al., "Controlled electropolishing of copper foils at elevated temperature." Applied surface science 307, Jul. 2014, 731-735, 5 pages.

U.S. Appl. No. 17/118,115, filed Dec. 10, 2020, Al-Rowaili et al.

Kang et al., "Effect of copper surface morphology on grain size uniformity of graphene grown by chemical vapor deposition." Current Applied Physics 19.12, 2019, 1414-1420, 7 pages.

Qin et al., "Roughness of copper substrate on three-dimensional tin electrode for electrochemical reduction of CQ2 into HCOOH" Journal of $CO_2$ Utilization 21, 2017, 219-223, 5 pages.

Uemoto et al., "Electrochemical Carbon Dioxide Reduction in Methanol at Cu and Cu2O-Deposited Carbon Black Electrodes." ChemEngineering 3.1, 15, 2019, 10 pages.

Du et al., "Mechanistic studies of Cu electropolishing in phosphoric acid electrolytes." Journal of The Electrochemical Society 151.6, Apr. 2004, 4 pages.

Heidari et al., "Kinetic model of copper electrodeposition in sulfate solution containing trisodium citrate complexing agent." Russian Journal of Electrochemistry 52.5, May 2016, 470-476, 7 pages.

Le et al., "Electrochemical reduction of CO2 to CH3OH at copper oxide surfaces." Journal of the Electrochemical Society 158.5, Mar. 2011, 5 pages.

PCT International Search Report and Written Opinion in International Appln. No. PCT/US2021/062700, dated Mar. 31, 2022, 16 pages.

Huo et al., "Study of anodic layers and their effects on electropolishing of bulk and electroplated films of copper," Journal of applied electrochemistry 34.3, Mar. 2004, 305-314, 10 pages.

PCT International Search Report and Written Opinion in International Appln. No. PCT/US2021/062701, dated Apr. 4, 2022, 15 pages.

Walton et al., "The Anode Layer in the Electrolytic Polishing of Copper" Journal of the Electrochemical Society (Jul. 1, 1950), vol. 97, No. 7, 219-226, 8 pages.

* cited by examiner

100

200

202

204

206

ELECTROCHEMICAL REDUCTION OF CARBON DIOXIDE

TECHNICAL FIELD

The present disclosure is directed to smoothing a surface of a metal electrode. More specifically, the disclosure is directed to the electropolishing of a copper electrode to form an atomically smooth surface.

BACKGROUND

The rising concentration of $CO_2$ in the atmosphere and its contributions to atmospheric instability have prompted numerous projects into the use or sequestration of the gas. For example, research has continued on the catalytic production of fuels or chemicals from $CO_2$, such as from power plant exhausts and other waste streams including high concentrations of $CO_2$. One technique for generating fuels and chemicals from $CO_2$ is the use of electrochemical reduction. Electrochemical reduction has numerous advantages, including simplicity, low cost, and the ability to use electrical power from renewable resources, such as solar or wind power.

SUMMARY

An embodiment described in examples herein provides a method for electrochemically reducing carbon dioxide to methanol. The method includes electropolishing a copper electrode to form an atomically smooth copper electrode, and electrochemically depositing copper (I) oxide crystals over the atomically smooth surface of the copper electrode to form an electrocatalytic electrode. The electrocatalytic electrode is used to electrochemically reduce the carbon dioxide to form methanol using the. The methanol is then isolated.

Another embodiment described in examples herein provides an electrocatalytic electrode. The electrocatalytic electrode includes copper (I) oxide crystals electrodeposited over an atomically smooth copper electrode.

DETAILED DESCRIPTION

The product of the electrochemical reduction of $CO_2$ largely depends on the metallic material selected as the electrode. Materials that can be used for the electrochemical include metallic materials that generate hydrogen gas, such as Ti, Ni, Fe, and Pt. Other metallic materials generate carbon monoxide during the electrochemical reduction, such as Zn, Ga, Pd, Ag, and Au. Yet other metallic materials generate hydrocarbons, $CH_4$ and $C_2H_4$, during the electrochemical reduction, such as Cu. Further metallic materials generate methanol during the electrochemical reduction, such as Ti, Sn, Cd, In, Hg, and Pb.

Techniques are provided herein for the electrochemical reduction of $CO_2$ to methanol using a catalyst formed by the electrodeposition of copper (I) oxide over a copper electrode. The degree of smoothness of the copper surface enhances the deposition of the metal compounds and, thus, the yield from the process. The oxidation state of copper, the smoothness of the copper surface, and the shape of crystals of copper (I) oxide increase the probability of methanol formation. Therefore, to increase the yield from the electrochemical reduction of $CO_2$, the electrode is smoothed prior to the use.

An atomically smooth surface enhances the electrodeposition of a catalyst layer and the yield of the electrochemical reduction of $CO_2$. Further, other metals such as Zn, Ti, Cd, Sn and Pb can be deposited on the smooth copper surface or co-deposited with copper (I) oxide to affect the product type.

The electrochemical reduction of $CO_2$ utilizes a low-cost waste feedstock for the generation of petrochemicals, such as methanol. The methanol may be used to generate other chemicals such as ethanol, hydrocarbons, propanol, and formic acid. The capture of the $CO_2$ may assist in sequestration, and widespread adoption of the techniques may help to reduce the total amount of atmospheric $CO_2$. The methanol generated in the techniques may be used as a fuel, for example, in fuel cells, combustion engines, and the like.

Figure 1:
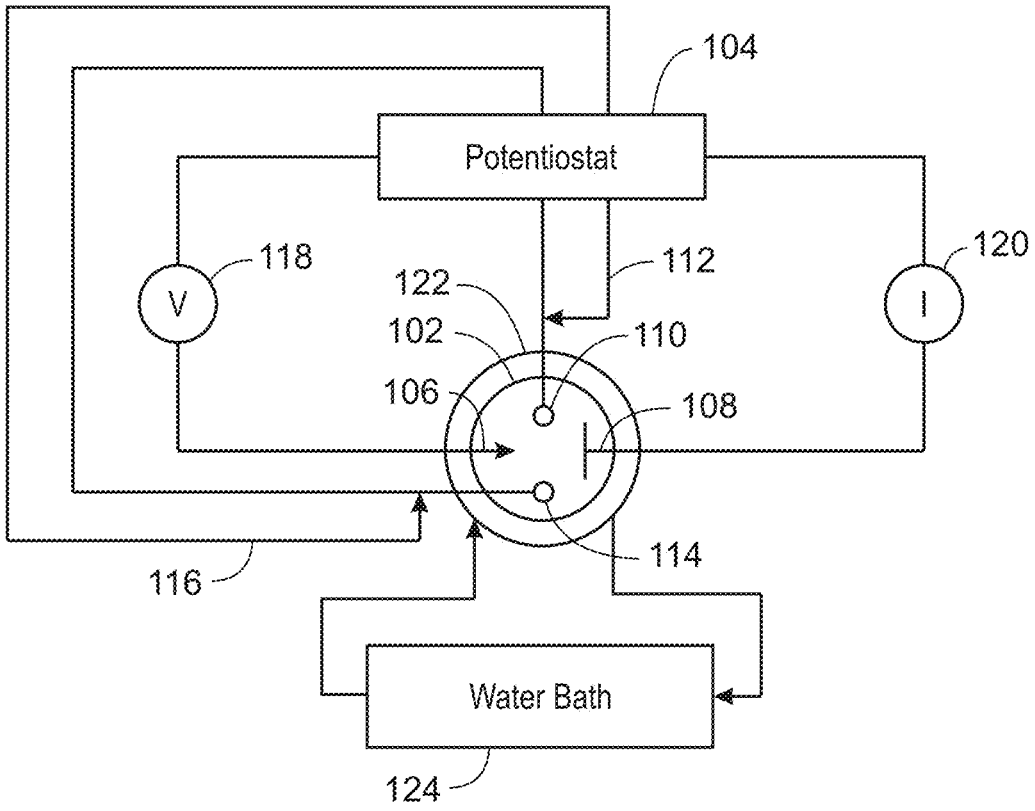
FIG. 1 is a drawing of an electrochemical cell used for the electropolishing of a surface of copper foil.

FIG. 1 is a drawing 100 of an electrochemical cell 102 used for the electropolishing of a surface of a copper electrode. A potentiostat 104 is coupled to electrodes in the electrochemical cell 102, such as a reference electrode 106, a counter electrode 108, and a working electrode 110. The potentiostat 104 provides current to the electrodes 106-110 to complete the electropolishing. In this embodiment, the working electrode 110 has a sense line 112 coupled between the working electrode 110 and the potentiostat 104 to measure the voltage potential between the reference electrode 106 and the working electrode 110.

In some embodiments, a second working electrode 114 is coupled to the potentiostat 104 to allow two copper electrodes to be electropolished at the same time. In the embodiment shown, a second sense line 116 is coupled between the second working electrode 114 and the potentiostat 104 to measure the voltage potential between the second working electrode 114 and the reference electrode 106.

The sense lines 112 and 116 allow the voltage 118 between the working electrodes 110 and 114 and the reference electrode 106 to be measured and controlled by the potentiostat 104. In some embodiments, the current 120 flowing through the electrochemical cell 102 is measured on the line to the counter electrode 108 and controlled by the potentiostat. In some embodiments, the counter electrode 108 is another copper electrode.

In some embodiments, the electrochemical cell 102 has a water jacket 122 to control the temperature of the electrochemical reaction in the electrochemical cell 102. In the embodiment shown, the water jacket 122 is coupled to a water bath 124 for temperature control. In other embodiments, the electrochemical cell 102 is partially submerged in the water bath 124.

For larger applications, an electrochemical cell with up to three electrodes, the working and the reference electrodes, may be placed inside a cathodic chamber. In this embodiment, the counter electrode is located in an anodic chamber, which is open to the atmosphere. An ion-exchange membrane is placed between the separated chambers to prevent the transportation of the oxygen gas evolved at the anodic cathode from reaching the cathodic chamber and oxidizing the products during electrolysis.

$CO_2$ is introduced into the cathodic chamber through a glass frit to remove oxygen. The dissolved $CO_2$ travels to the surface of the cathode to complete the electrocatalytic carbon dioxide reduction.

Figure 2:
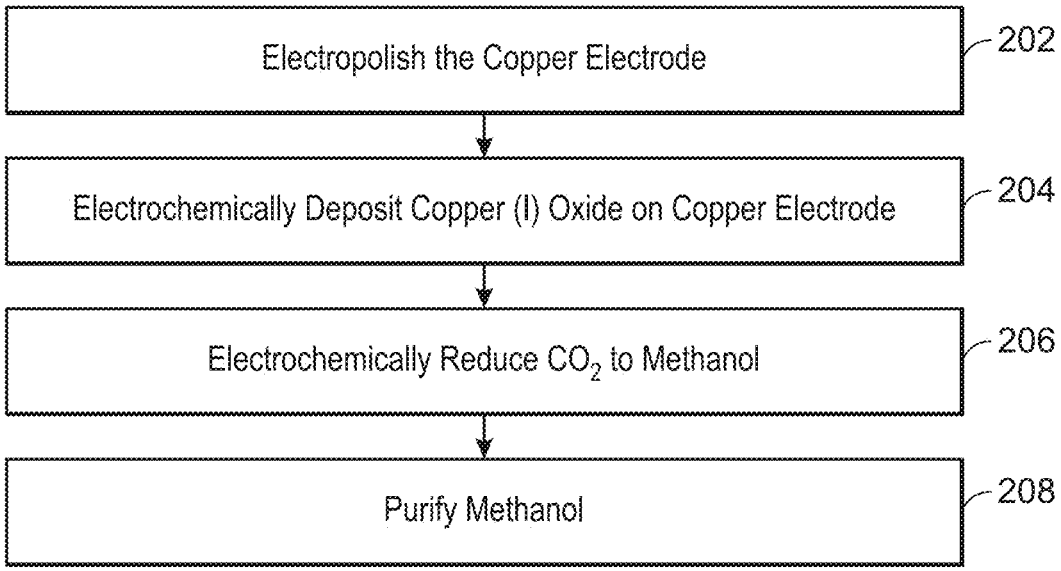
FIG. 2 is a method for electrochemically reducing carbon dioxide to methanol.

FIG. 2 is a process flow diagram of a method 200 for electrochemically reducing $CO_2$ to form methanol. The method 200 begins at block 202 with the electropolishing of a copper electrode to form an atomically smooth surface. The electropolishing may be performed as described with respect to FIG. 3. At block 204, a copper (I) oxide catalyst is deposited on the electropolished copper electrode to form an electrocatalytic electrode. This may be performed as described with respect to FIG. 4. At block 206, carbon dioxide is electrochemically reduced to methanol using the electrocatalytic electrode.

At block 208, the electrolyte is purified to remove the methanol formed. This may be performed by distillation, stripping, adsorption processes, membrane filtration, and the like.

Figure 3:
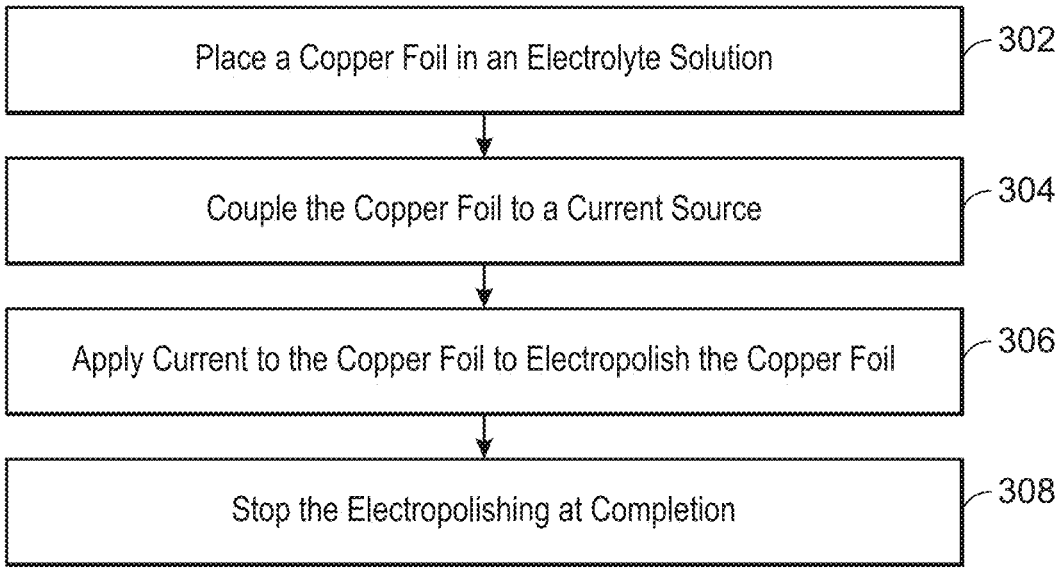
FIG. 3 is a process flow diagram of a method for electropolishing a surface of copper foil.

FIG. 3 is a process flow diagram of a method 202 for electropolishing a surface of copper foil. The method begins at block 302 when a copper foil is placed in an electrolyte solution. As described herein, the electrolyte solution includes ethylene glycol and phosphoric acid, prepared as described with respect to the examples.

At block 304, the copper foil is coupled to a current source, such as a potentiostat. The coupled copper foil is placed electrochemical cell, for example, using an Ag/AgCl reference electrode to measure voltage in the cell, and a copper foil counter electrode. In some embodiments, two copper foils are coupled to the current source for simultaneous electropolishing of both copper foils.

At block 306, current is applied to the copper foil to electropolish the copper foil. The current oxidizes the surface of the copper foil, removing copper ions. Higher and rougher features are preferentially removed, smoothing the surface. In some embodiments, the electropolishing is performed at a current of between about 300 mA/0.25 $cm^2$ and 450 mA/0.25 $cm^2$, at a current of between about 350 mA/0.25 $cm^2$ and 410 mA/0.25 $cm^2$, or at a current of 380 mA/0.25 $cm^2$. In some embodiments, the temperature is controlled at between about 50° C. and about 80° C., or between about 60° C. and about 70° C., or at about 65° C.

At block 308, the electropolishing is stopped at completion, for example, when the surface has reached a satisfactory degree of smoothness. In some embodiments, the electropolishing is continued for between about 9 minutes and about 14 minutes, or for between about 10 min and about 13 minutes, or for about 11.5 minutes. In some embodiments, the completion of the electropolishing process is determined by the color of the electrolyte solution. When the electrolyte solution turns light blue, in about 11.5 minutes, the electropolishing process is stopped.

Figure 4:
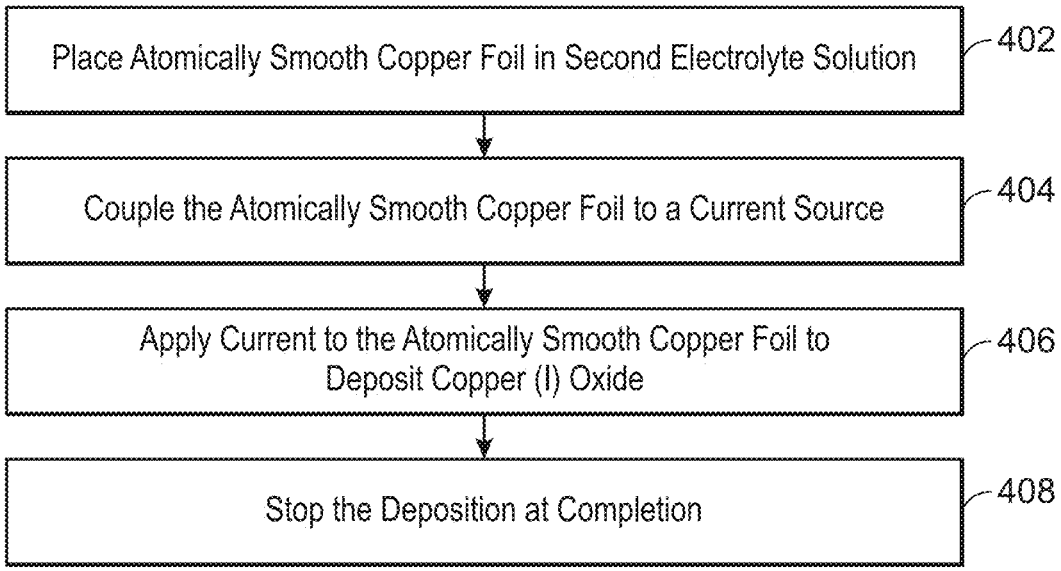
FIG. 4 is a process flow diagram of a method for depositing a copper (I) oxide on the electropolished copper foil.

FIG. 4 is a process flow diagram of a method 204 for depositing a copper (I) oxide catalyst on the atomically smooth surface of the copper foil. The method 204 begins at block 402 when the atomically smooth copper foil is placed in a second electrolyte solution. The second electrolyte solution comprises a source of copper ions. In some embodiments, the second electrolyte solution includes copper (II) sulfate and trisodium citrate. The citrate compound is used as a complexing agent in the electrolyte to enhance the electrodeposition process.

At block 404, the atomically smooth copper foil is coupled to a current source. In some embodiments, the same current source used for electropolishing the copper foil is used for the deposition of the copper (I) oxide crystals on the surface.

At block 406, current supplied to the atomically smooth copper foil to cause the electrodeposition of the copper (I) oxide crystals. In some embodiments, the electrodeposition is performed at a current of between about 300 mA/2 $cm^2$ and 450 mA/2 $cm^2$, at a current of between about 350 mA/2 $cm^2$ and 410 mA/2 $cm^2$, or at a current of 380 mA/2 $cm^2$. In some embodiments, the temperature is controlled at between about 50° C. and about 80° C., or between about 60° C. and about 70° C., or at about 65° C.

At block 408, the deposition of the copper (I) oxide crystals is stopped at completion. In some embodiments, completion is determined by the time for the deposition, for example, about two minutes to about 20 minutes, or from about five minutes to about 15 minutes, or from about eight minutes to about 12 minutes, or for about 10 minutes.

Figure 5:
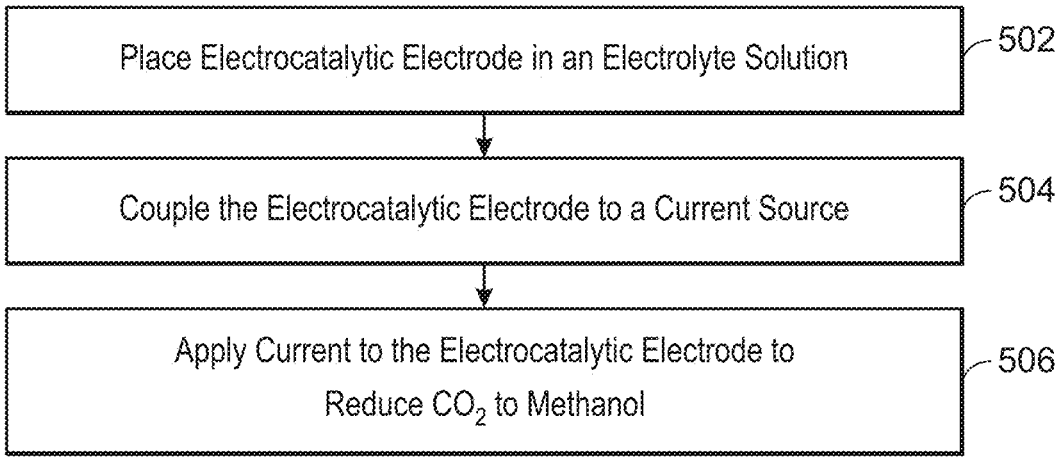
FIG. 5 is process flow diagram of a method for electrochemically reducing carbon dioxide to methanol using an electrocatalytic electrode.

FIG. 5 is process flow diagram of a method 206 for electrochemically reducing carbon dioxide to methanol using an electrocatalytic electrode. The method 206 begins at block 502, when the electrocatalytic electrode is placed in electrolyte solution. In some embodiments, the electrolyte solution includes potassium bicarbonate, although other carbonate buffer solutions may be used. In some embodiments, the pH of the buffer solution is about 8. The pH of the potassium bicarbonate solution is set at about 9.0 by using 0.5M of NaOH. The concentration is 16.7 g/L.

At block 504, the electrocatalytic electrode is coupled to a current source. At block 506, current is applied to the electrocatalytic electrode to reduce $CO_2$ to methanol. The $CO_2$ used in the present examples is from the atmosphere. However, $CO_2$ may be added to the reaction to replace the $CO_2$ used in the electrochemical reduction. For example, in a commercial process, $CO_2$ from a combustion process may be used as a reactant in the electrochemical reduction.

Examples

Materials and Equipment

Phosphoric acid was purchased as an 85% solution (con), e.g., pure ortho-phosphoric acid, from Sigma-Aldrich of St. Louis, Mo., USA, and used without further purification. Ethylene glycol was purchased as a neat liquid from Sigma-Aldrich and used without further purification.

For the electropolishing, an electrolyte solution of 3 M phosphoric acid and 0.2 M ethylene glycol was prepared in DI water. The electrolyte solution was prepared by adding 174.47 milliliters (mL) of the con phosphoric acid and 11.18 mL of the ethylene glycol to 814.35 mL of DI water.

Copper sulfate was purchased from Sigma-Aldrich. Trisodium citrate was purchased from Sigma-Aldrich. Potassium hydroxide was purchased from Sigma-Aldrich and used to mix a 0.5 M solution. For the electrodeposition of the catalyst, an electrolyte solution of copper sulfate and trisodium citrate was prepared by adding 1.25 g of copper sulfate and 0.735 g of trisodium citrate to 75 mL of DI water. The pH of the electrolyte solution was adjusted to 9.0 by the addition of the 0.5 M solution of KOH.

Potassium bicarbonate was purchased from Sigma-Aldrich. An electrolyte solution of potassium bicarbonate was prepared by adding 50.06 g of potassium bicarbonate to 1000 mL of DI water, giving a concentration of 0.5 molar (M).

Copper foil was purchased as a roll from Sigma-Aldrich. Flags were cut from the copper foil, wherein the flags had a 2 $cm^2$ square lower section, and a narrow section extending upward for coupling to wires from the potentiostat. The reference electrode used for the electropolishing was an Ag/AgCl electrode purchased from Sigma-Aldrich.

The potentiostat was a Reference 3000 model from Gamry Instruments Company of Warminster, Pa., USA. The field emission scanning electron microscope (FESEM) was a LYRA 3, Dual Beam, from Tescan, of Brno, CZ. The FESEM was coupled with an energy dispersive X-ray spectrometer (EDX) from Oxford Instruments of Abingdon, UK. The FESEM was run at an SEM HV of 15 kV, with a view field of 3.00 μm, and an SEM Magnification of 63.6 kx. The AFM was an Innova AFM from Bruker of Billerica, Mass., USA.

Procedures

Electropolishing

Copper foil of about 2 $cm^2$ of area was galvanically polished in an electrolyte solution comprising ethylene glycol and phosphoric acid (3M Phosphoric Acid+0.2M Ethylene Glycol) at a temperature of 65° C. using water circulator. The counter electrode used was a second flag-shaped copper foil and the reference electrode was an Ag/AgCl electrode. The electropolishing was performed using the potentiostat at a set current of 380 mA/0.25 $cm^2$ for 11.5 minutes. More than one working electrode was electropolished at a time until the electrolyte solution changed color to light blue, indicating completion of the electropolishing.

Catalyst Deposition

The controlled electrodeposition of copper oxide on the polished smooth surface of the copper foil was performed in an electrolyte solution of copper sulfate at 16 g/L and trisodium citrate at 9.8 g/L. The pH of the electrolyte solution was adjusted to 9.0 with a 0.5 M KOH solution. A platinum wire or counter electrode with frit was used and an Ag/AgCl electrode was used as the reference electrode. The electrodeposition was carried out during cyclic voltammetry (CV) for 5 cycles of 90 seconds each from 0.4 v to 0.6 v. The CV was carried out by using Gamry 3000 and the corresponding reduction potential peak of $Cu^+$ was noted at about 500 mV.

Electrochemical Reduction of $CO_2$

Once the copper oxide was deposited over the copper foil, the electrochemical reduction of $CO_2$ to methanol was tested. This was performed in an electrolyte solution of potassium bicarbonate using the $Cu_2O$-electrodeposited copper foil electrode. An excess of $CO_2$ was added to the glass tube to provide a sufficient volume for the reduction. The $CO_2$ was provided from a low-pressure gas cylinder and bubbled into the glass tube. The glass tube was closed as the gas was purged from the cylinder. Linear sweep voltammetry (LSV) was run first on the working electrode to determine its reduction potential onset range. This was performed by the measurement of the current at the working electrode (polished copper) while sweeping the potential between the working electrode and the reference electrode linearly in time. The initial and the final potentials were noted and used to determine the LSV range. The reference and the counter electrodes were Ag/AgCl and platinum, respectively. The tests were run inside a fritted glass tube.

Electrolyte from the electrochemical reduction of $CO_2$ may be analyzed by gas chromatography to ascertain the amount of methanol produced and to identify any other possible unexpected products such as ethanol and hydrocarbons. The primary product of the electrochemical reaction was methanol. The methanol may be used as a feedstock and further processes, for example, to generate hydrocarbons such as methane and ethylene, or alcohols, acetone and formic acid, among others Surface Analysis The electropolished copper foil working electrode was examined to ascertain the level of smoothness achieved. Micrographs of the surface of the electropolished copper foil were collected using FESEM and AFM.

Figures 6A, 6B:
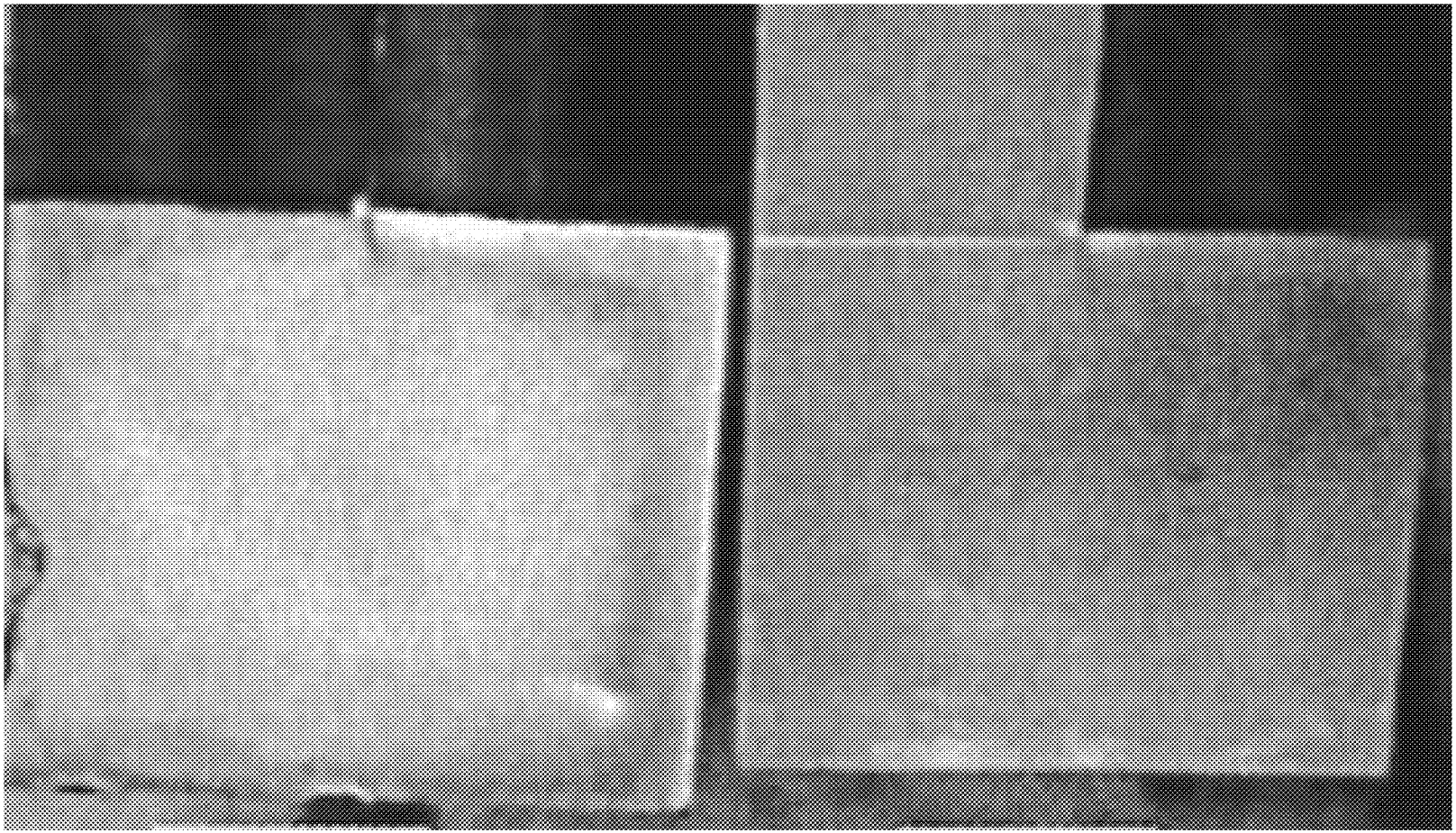
FIGS. 6A and 6B are images of a copper foil surface before and after electropolishing.
Figures 7A, 7B, 7C:
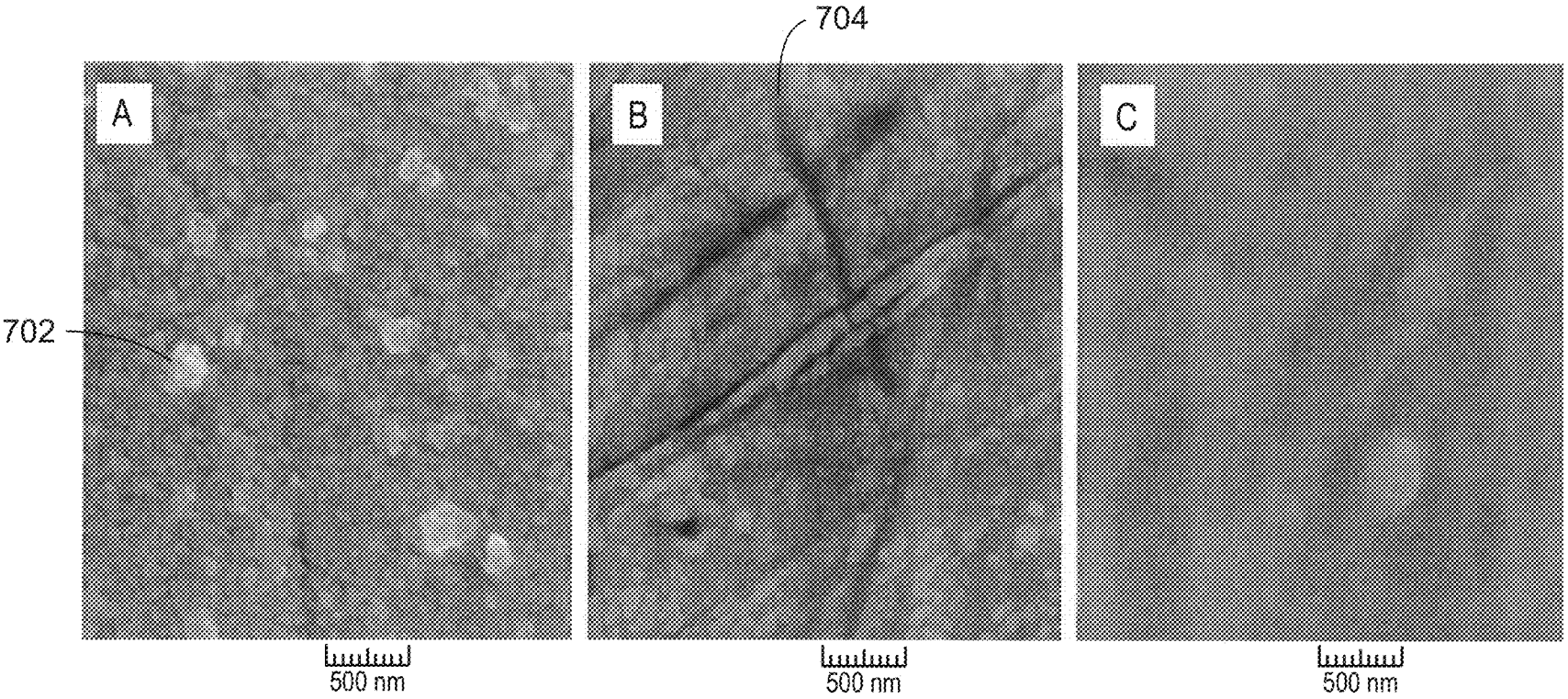
FIGS. 7A, 7B, and 7C are micrographs of an electropolish surface in comparison to a raw surface and a mechanically polished surface collected using a field emission scanning electron microscope (FESEM).

FIGS. 6A and 6B are images of an electropolished copper foil surface and a non-electropolished surface. The electropolished copper, shown in FIG. 6A, is smoother than that of the unpolished copper foil, shown in FIG. 6B, as indicated by the higher surface reflectance. 6A is suitable for electrochemical reduction of $CO_2$ FIGS. 7A, 7B, and 7C are micrographs of an electropolished surface in comparison to a raw surface and a mechanically polished surface collected using a field emission scanning electron microscope (FESEM). FIG. 7A is a micrograph of the surface of the copper foil as received. In FIG. 7A, copper crystals 702 are visible. The copper crystals 702 may be polished to form a smoother surface. FIG. 7B shows the copper foil after polishing with 10 μm alumina particles. However, this leaves scratches 704 on the surface. FIG. 7C shows the surface of the copper foil after electropolishing for 5 min at 380 mA/cm2 in an electrolyte solution of 3 M phosphoric Acid and 0.2 M ethylene glycol. As shown in FIG. 7C, the surface is smoother and suitable for forming catalyst for the electrochemical reduction of $CO_2$.

Figure 8B:
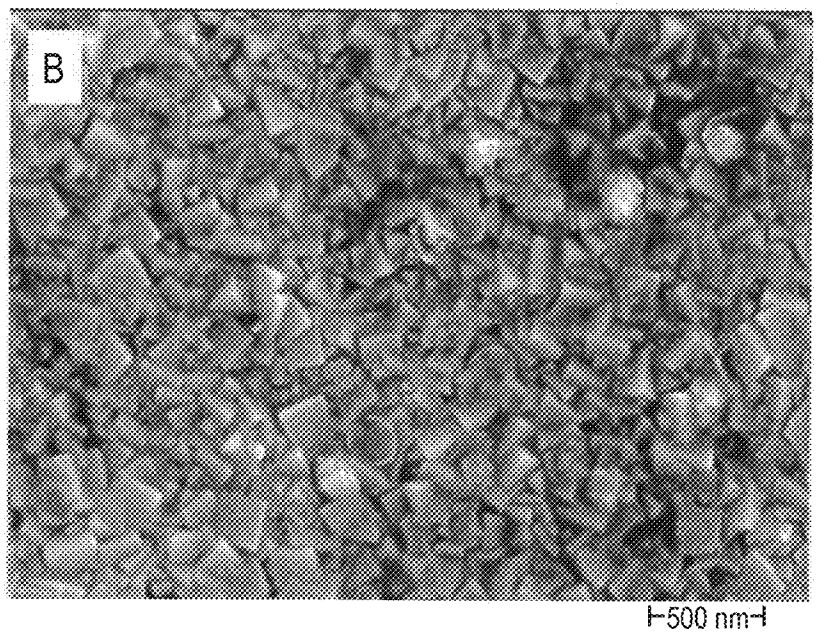
FIGS. 8A and 8B are micrographs of deposit copper (I) oxide crystals at 2 different magnifications collected using a field emission scanning electron microscope (FESEM).
Figure 8A:
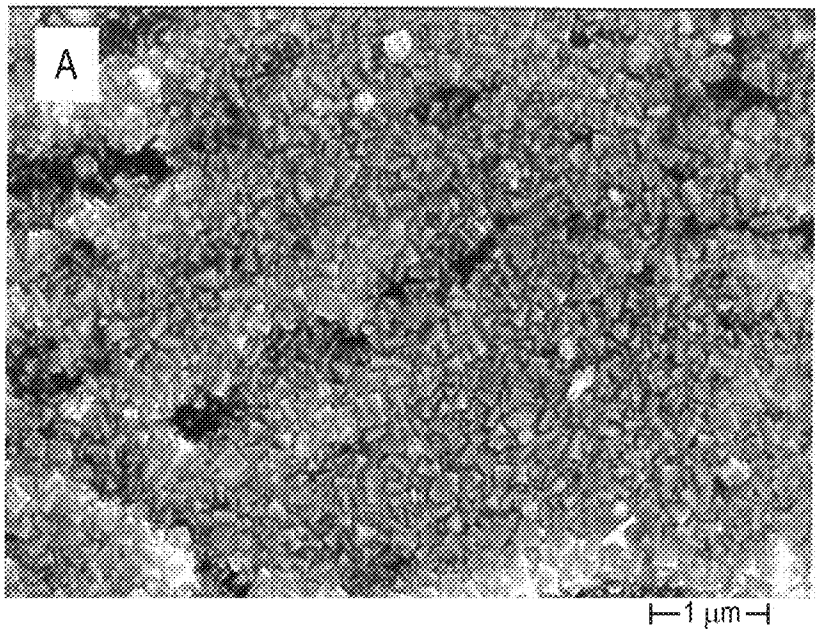

FIGS. 8A and 8B are micrographs of electrodeposited copper (I) oxide crystals at two different magnifications collected using a field emission scanning electron microscope (FESEM). The crystals of $Cu_2O$ deposited on the Cu foil can be seen clearly, and are about 100 nm to about 250 nm across. Further, the crystals are symmetrical.

Figures 9A, 9B, 9C:
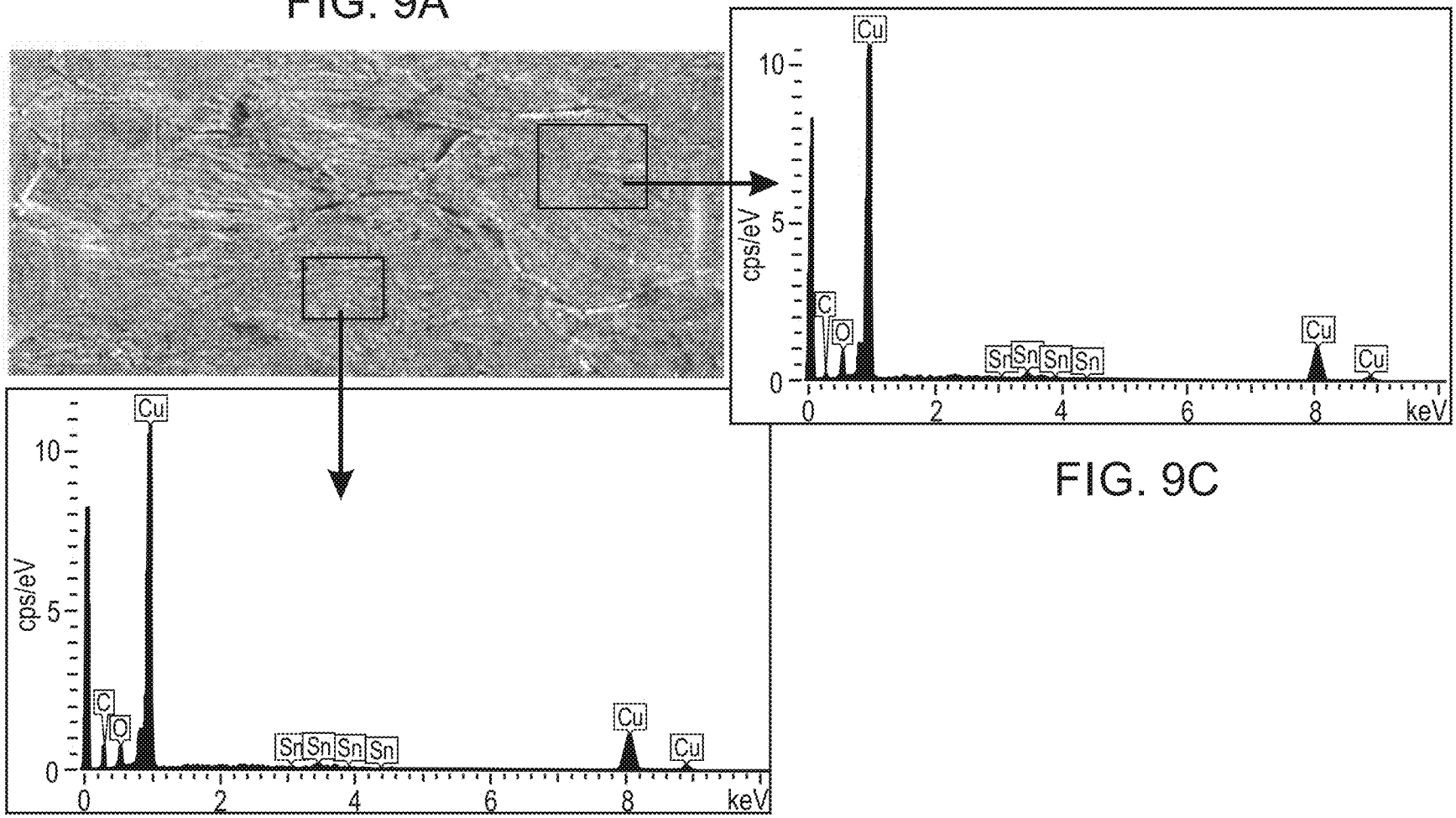
FIGS. 9A, 9B, and 9C show analysis results of different points on the electrocatalytic surface.

FIGS. 9A, 9B, and 9C show analysis results of different points on the electrocatalytic surface. The images obtained with FESEM after the deposition of Cu20, and the corresponding energy-dispersive X-ray spectroscopy (EDX) plots of some locations, revealed a high percentage of Cu present.

Figures 10A, 10B, 10C:
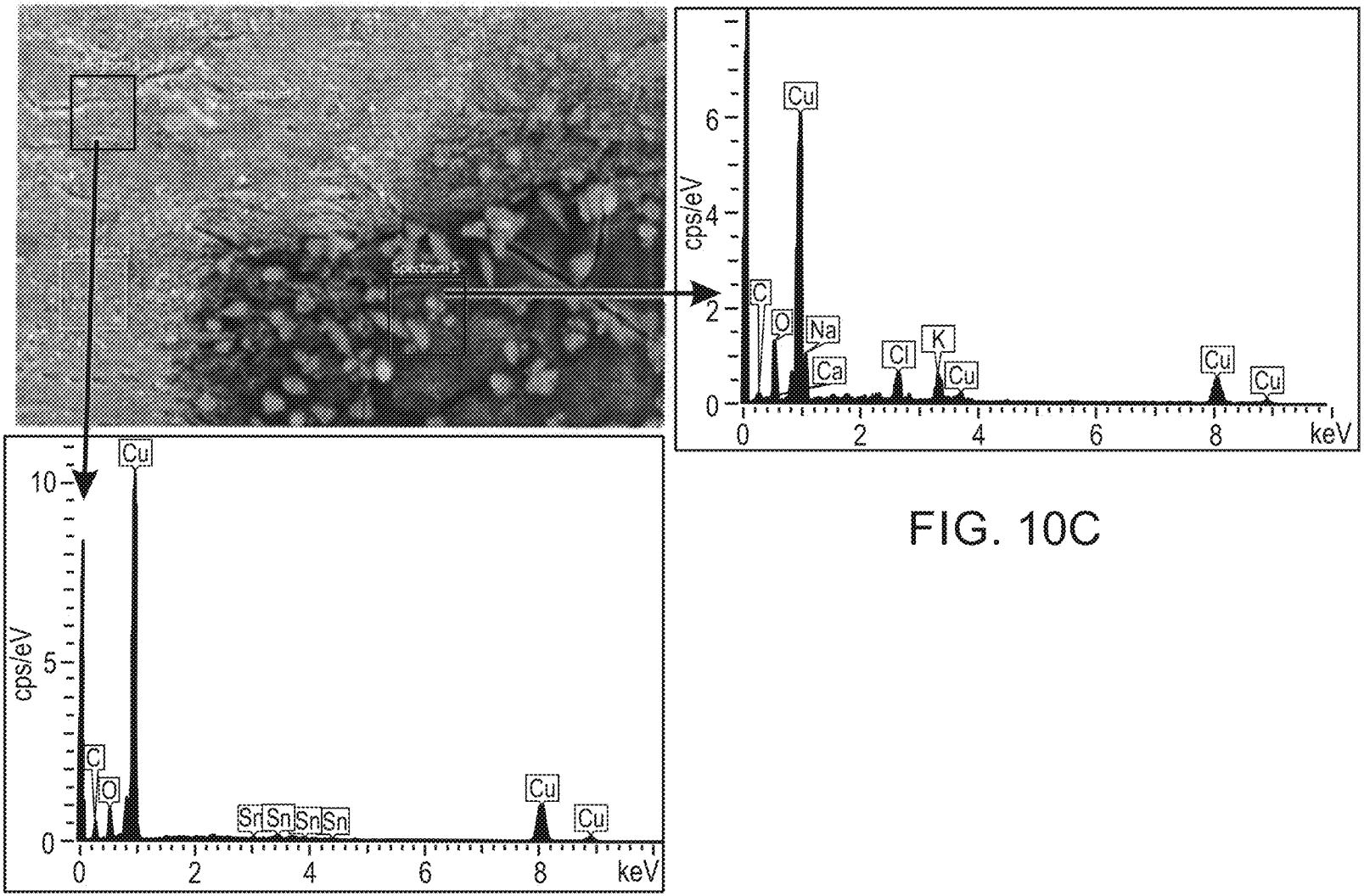
FIGS. 10A, 10B, and 10C show analysis results of different points on an electrocatalytic surface.

FIGS. 10 A, 10 B, and 10 C show analysis results of different points on an electrocatalytic surface. As seen in FIG. 10A, after deposition, most of the image showed $Cu_2O$ crystals, with some darker areas having few or no crystals. The dark spots revealed no Cu presence. It also shows that most of the surface of the Cu foil is deposited with cube-shaped crystals. The EDX plots show a higher carbon signal from the dark sites.

An embodiment described in examples herein provides a method for electrochemically reducing carbon dioxide to methanol. The method includes electropolishing a copper electrode to form an atomically smooth copper electrode, and electrochemically depositing copper (I) oxide crystals over the atomically smooth surface of the copper electrode to form an electrocatalytic electrode. The electrocatalytic electrode is used to electrochemically reduce the carbon dioxide to form methanol using the. The methanol is then isolated.

In an aspect, the method includes electropolishing the copper electrode by placing the copper electrode in a first electrolyte solution including ethylene glycol and an acid. The copper electrode is coupled to a current source. A current is applied to the copper electrode to electropolish the copper electrode to form the atomically smooth copper electrode and the electropolishing is stopped when the electropolishing is completed.

In an aspect, the first electrolyte solution is formed by mixing an 85% phosphoric acid solution into water and then adding the ethylene glycol to the electrolyte solution. In an aspect, the first electrolyte solution is formed at a 3 molar (M) concentration of phosphoric acid and a 0.2 M concentration of ethylene glycol. In an aspect, the current is applied to the copper electrode at about 380 mA per 2 $cm^2$.

In an aspect, the method includes determining that the electropolishing is completed when the first electrolyte solution changes color to blue. In an aspect, the method includes determining that the electropolishing is completed after about 11.5 minutes. In an aspect, the temperature is controlled during the electropolishing at about 65° C.

In an aspect, the method includes electrochemically depositing the copper (I) oxide by placing the atomically smooth copper electrode in a second electrolyte solution including copper (II) ions. The atomically smooth copper electrode is coupled to a current source. Current is supplied to the atomically smooth copper electrode to deposit the copper (I) oxide crystals to form the electrocatalytic electrode.

In an aspect, the method includes forming the second electrolyte solution using about 16 g/L of copper (II) sulfate. In an aspect, the method includes forming the second electrolyte solution using 9.8 g/L of trisodium citrate. In an aspect, the method includes applying the current to the atomically smooth copper electrode at about 380 mA per 2 $cm^2$.

In an aspect, the method includes electrochemically reducing carbon dioxide by: placing the electrocatalytic electrode in a third electrolyte solution; coupling the electrocatalytic electrode to a current source; and applying current to the electrocatalytic electrode to reduce $CO_2$ to methanol.

In an aspect, the method includes forming the third electrolyte solution using 16.7 g/L of potassium bicarbonate. In an aspect, the method includes adjusting the pH of the third electrolyte solution to about 9. In an aspect, the method includes applying the current to the electrocatalytic electrode at about 190 mA/$cm^2$.

Another embodiment described in examples herein provides an electrocatalytic electrode. The electrocatalytic electrode includes copper (I) oxide crystals electrodeposited over an atomically smooth copper electrode.

In an aspect, the atomically smooth copper electrode is formed by placing a copper electrode in a first electrolyte solution including ethylene glycol and electrode acid. The copper electrode is coupled to a current source. Current is applied to the copper electrode to electropolish the copper electrode to form the atomically smooth copper electrode. The electropolishing is stopped when the electropolishing is completed.

In an aspect, the first electrolyte solution includes a 3 molar (M) concentration of phosphoric acid and a 0.2 M concentration of ethylene glycol.

In an aspect, the copper (I) oxide crystals are electrodeposited over the atomically smooth copper electrode by placing the atomically smooth copper electrode in a second electrolyte including copper (II) ions. The atomically smooth copper electrode is coupled to a current source. Current is applied to the atomically smooth copper electrode to deposit the copper (I) oxide crystals to form the electrocatalytic electrode. In an aspect, the second electrolyte includes copper (II) sulfate and trisodium citrate.

Other implementations are also within the scope of the following claims.

What is claimed is:

1. A method for electrochemically reducing carbon dioxide to methanol, comprising:

electropolishing a copper electrode to form an atomically smooth copper electrode by:

placing the copper electrode in a first electrolyte solution consisting of a 0.2 molar (M) solution of ethylene glycol and a 3 M solution of phosphoric acid;

coupling the copper electrode to a current source;

applying current to the copper electrode to electropolish the copper electrode to form the atomically smooth copper electrode; and stopping the electropolishing when the electropolishing is completed;

electrochemically depositing copper (I) oxide crystals over the atomically smooth copper electrode to form an electrocatalytic electrode;

electrochemically reducing the carbon dioxide to form the methanol using the electrocatalytic electrode; and isolating the methanol.

2. The method of claim 1, further comprising forming the first electrolyte solution by mixing an 85% solution of phosphoric acid into water and then adding the ethylene glycol.

3. The method of claim 1, further comprising determining that the electropolishing is completed when the first electrolyte solution changes color to blue.

4. The method of claim 1, further comprising determining that the electropolishing is completed after about 11.5 minutes.

5. The method of claim 1, further comprising controlling a temperature during the electropolishing at about 65° C.

6. The method of claim 1, wherein the copper (I) oxide is electrochemically deposited by:

placing the atomically smooth copper electrode in a second electrolyte solution comprising copper (II) ions;

coupling the atomically smooth copper electrode to a current source; and applying current to the atomically smooth copper electrode to deposit the copper (I) oxide crystals to form the electrocatalytic electrode.

7. The method of claim 6, further comprising forming the second electrolyte solution using about 16 g/L of copper (II) sulfate.

8. The method of claim 6, further comprising forming the second electrolyte solution using 9.8 g/L of trisodium citrate.

9. The method of claim 1, wherein the carbon dioxide is electrochemically reduced by:

placing the electrocatalytic electrode in a third electrolyte solution;

coupling the electrocatalytic electrode to a current source; and applying current to the electrocatalytic electrode to reduce the carbon dioxide to the methanol.

10. The method of claim 9, further comprising forming the third electrolyte solution using about 16.7 g/L of potassium bicarbonate.

11. The method of claim 10, further comprising adjusting the pH of the third electrolyte solution to about 9.

12. The method of claim 9, wherein the current to the electrocatalytic electrode is applied at about 190 $mA/cm^2$.

* * * * *